United States Patent [19]

Suzuki et al.

[11] Patent Number: 4,966,825

[45] Date of Patent: Oct. 30, 1990

[54] METHOD FOR PRODUCING ELECTROPHOTOGRAPHIC LIQUID DEVELOPER

[75] Inventors: Nobuo Suzuki; Yutaka Sakasai; Hideo Sato, all of Kanagawa, Japan

[73] Assignee: Fuji Photo Film Co., Ltd., Kanagawa, Japan

[21] Appl. No.: 474,688

[22] Filed: Feb. 6, 1990

Related U.S. Application Data

[63] Continuation of Ser. No. 240,907, Sep. 7, 1988, abandoned.

[30] Foreign Application Priority Data

Sep. 7, 1987 [JP] Japan ..... 62-223584
Sep. 7, 1987 [JP] Japan ..... 62-223585

[51] Int. Cl.[5] ..... G03G 5/00
[52] U.S. Cl. ..... 430/137; 430/114; 430/115
[58] Field of Search ..... 430/114, 115, 137

[56] References Cited

U.S. PATENT DOCUMENTS 4,614,699 9/1986 Kitatani et al. ..... 430/115
4,760,009 7/1988 Larson ..... 430/114 X

FOREIGN PATENT DOCUMENTS 1443282 7/1976 United Kingdom ..... 430/114

*Primary Examiner*—Roland E. Martin
*Attorney, Agent, or Firm*—Sughrue, Mion, Zinn, Macpeak & Seas

[57] ABSTRACT

A method for producing an electrophotographic liquid developer comprising: (A) a mixing step of stirring a mixture comprising a coloring agent, an ethylenic copolymer, and an electrically insulating liquid having an affinity with the copolymer, at a temperature higher than the softening point of the copolymer; (B) a dispersing step of dispersing the mixture in an electrically insulating liquid after cooling to a temperature below the softening point of the copolymer; and (C) a diluting step of diluting the dispersion with an electrically insulating liquid to provide a liquid developer for use; wherein step (A) and/or step (B) is performed in the presence of a charge controlling agent or a basic nitrogen-containing polymer.

9 Claims, No Drawings

METHOD FOR PRODUCING ELECTROPHOTOGRAPHIC LIQUID DEVELOPER

This is a continuation of application Ser. No. 240,907 filed Sept. 7, 1988, now abandoned.

FIELD OF THE INVENTION

This invention relates to a method for producing an electrophotographic liquid developer having improved dispersion characteristics for developing electrostatic latent images.

BACKGROUND OF THE INVENTION

An electrophotographic liquid developer is generally composed of a coloring agent such as carbon black and other various pigments; a coating material adsorbed onto or coating on the coloring agent for controlling the electrostatic charge of the toner particles and the dispersion of the toner particles, and further imparting a property of fixing images after development to the toner particles; a dispersing agent which is dissolved in or swelled with a carrier liquid for improving the dispersion stability of the toner particles; a charge controlling agent for controlling the electrostatic charge of the toner particles; and a carrier liquid having a high electric resistance ($10^9$ to $10^{15}\Omega\cdot$cm).

For producing such a liquid developer, the following method is generally employed.

First, a coloring agent is mixed with a resin as a coating material and they are melt-kneaded by means of a kneading machine such as a Banbury mixer, an extruder, a kneader, a three-roll mill, etc., at a temperature of higher than the softening point of the coating material to provide a solid mixture. Alternatively, a coloring agent and a coating material is dispersed under kneading in a compatible solvent by means of a dispersing device such as a ball mill, an attritor, etc. The kneaded mixture is then dried or added to a nonsolvent to provide a solid mixture.

The solid mixture thus-obtained is dry-ground by means of a grinder and then dispersed in a small amount of a liquid having a similar electric resistance to that of a carrying liquid together with a dispersing agent by a dispersing machine, such as a ball mill, a paint shaker, a sand mill, etc., to provide a condensed toner liquid. The condensed toner liquid is added to a carrier liquid containing a charge controlling agent to provide an electrophotographic liquid developer.

However, it has now been found that when an ethylenic copolymer is used as a coating material, it is very difficult to disperse the ground solid mixture containing the copolymer by the method described above. Hence, a dispersion capable of being practically used for an electrophotographic liquid developer has not heretofore been obtainable.

As a method of dispersing an ethylenic copolymer, there has been proposed a plasticizing method of using a nonpolar solvent, e.g., in JP-A- No. 61-180248 (the term "JP-A" as used herein refers to a "published unexamined Japanese patent application"). According to this method, a mixture of an ethylenic copolymer, a pigment, and a nonpolar solvent is heated to a temperature of higher than the temperature capable of making the copolymer soluble, cooled, solidified, and then coarsely ground. Thereafter, the ground mixture is dispersed in a nonpolar solvent using a media type dispersing device.

In this method the cohesive force of the copolymer chain is weakened by plasticizing the copolymer for making the copolymer easily dispersible.

However, the dispersion degree of the dispersion obtained by the aforesaid method is insufficient.

For improving the dispersibility of the dispersion, a method using a polar solvent is described in U.S. Pat. No. 4,631,244. However, this method is not always preferable in charging characteristics for an electrophotographic liquid developer using an electrically insulating liquid as the carrier liquid.

Also, the dispersibility may be improved through mechanical means, but the application of large impact force or shearing force is disadvantageous since this method causes the release of the coloring agent from the covered copolymer and the occurrence of denaturing of the copolymer or the coloring agent itself, which results in changing the fundamental characteristics of the dispersion. Furthermore, such a method increases the production costs of the liquid developer. Thus, the aforesaid method is not preferred for producing an electrophotographic liquid developer.

As described above, an ethylenic copolymer is only slightly dispersible in solvent by ordinary methods, owing to the cohesive energy of the copolymer itself. Hence, when an electrophotographic liquid developer is prepared using an ethylenic copolymer as a coating material, it frequently happens that images of good quality are not obtained caused by the inferiority in dispersibility.

SUMMARY OF THE INVENTION

An object of this invention is, therefore, to provide a method for producing an electrophotographic liquid developer using an ethylenic liquid developer as a coating material, said method being capable of improving the dispersibility of the liquid developer without using polar solvent or large mechanical force.

Another object of this invention is to provide an electrophotographic liquid developer which is excellent in image reproducibility and is suitable for toner image transfer.

As the result of various investigations, the inventors have discovered that the aforesaid objects can be attained by a method of producing an electrophotographic liquid developer comprising:

(A) a mixing step of stirring a mixture comprising a coloring agent, an ethylenic copolymer, and an electrically insulating liquid having an affinity with the copolymer, at a temperature higher than the softening point of the copolymer;

(B) a dispersing step of dispersing the mixture in an electrically insulating liquid, after cooling to a temperature below the softening point of the copolymer; and (C) a diluting step of diluting the dispersion with an electrically insulating liquid (i.e., a carrier liquid);

wherein step (A) and/or step (B) is performed in the presence of a charge controlling agent or a basic nitrogen-containing polymer.

DETAILED DESCRIPTION OF THE INVENTION

The invention is described in detail below.

First, an ethylenic copolymer, an electrically insulating liquid having an affinity with the copolymer, and a coloring agent (such as pigment, etc.) are stirred at a temperature higher than the softening point of the copolymer to provide a mixture. In this case it is preferred to stir the mixture of the aforesaid components with a device having a dispersing action, such as, for example, a kneader, a Banbury mixer, a planetary mixer, a roll mill, a ball mill, an attritor, etc.

Then, the mixture is cooled to a temperature lower than the softening point of the copolymer to be solidified.

Thereafter, the solidified mixture is coarsely ground. The ground mixture is wet-dispersed in an electrically insulating liquid using a media type dispersing device such as a ball mill, a paint shaker, an attritor, a dyno mill, etc.

Then, the thus-obtained dispersion is diluted to a desired concentration using an electrically insulating liquid to obtain an electrophotographic liquid developer. Several kinds of additives can be added to the liquid developer at this step.

The novel feature of this invention is performing the dispersion step(s) in the coexistence of a charge controlling agent or a basic nitrogen-containing polymer. Since the objects of this invention can be attained only if the aforesaid component exists in the dispersion step, the aforesaid component may be added to the mixture in step (A) of obtaining the initial mixture, step (B) of dispersing the mixture obtained in step (A), or both steps (A) and (B). However, the addition step for the component is preferably the dispersion step, and particularly preferably the initial mixing step.

The ethylenic copolymer for use in this invention has large internal cohesive force and large mechanical strength. Thus, a liquid developer produced using such a copolymer is excellent in fixing and transferring properties. On the other hand, the large internal cohesive force means that the dispersion of the copolymer is difficult, due to the cohesive force.

The inventors have succeeded in improving the dispersibility of the electrophotographic liquid developer using the copolymer.

The reasons for this effect of this invention has not yet been sufficiently clarified, but is considered to be follows. A mixture of the copolymer as a coating material and a coloring agent is finely dispersed by the impact force and grinding stress of media. In this case, the dispersed particles are coagulated again by the cohesive force of the copolymer.

The formation of fine particles by dispersion and the formation of coarse particles by aggregation occur simultaneously in the dispersion system and reach a certain equilibrium. Even when the dispersion time is prolonged, the size of the particles is not changed. As the cohesive force of the copolymer becomes larger, particle size at the equilibrium becomes larger.

However, it is considered that when a charge controlling agent or a basic nitrogen-containing polymer exists in the dispersion system, the cohesive force among the particles is weakened to improve the dispersibility of the particles.

That is, it is considered that the effect of this invention is as follows.

When a charge controlling agent exists in the dispersion system, the ion component formed by the dissociation of the charge controlling agent adsorbs onto the particles to give an electrostatic charge thereto, and the cohesive force among the particles is weakened by the repulsion of the charge on the particles, whereby the impact force and shearing force from the media are effectively applied to the particles and, thus, the dispersibility of the particles is improved. Alternatively, when a basic nitrogen-containing polymer exists in the dispersion system, the cohesive force based on the acid group of the copolymer is weakened by the co-action of the acid group in the copolymer and the basic nitrogen of the basic polymer, whereby the impact force and shearing force at dispersion effectively act on the particles to improve the dispersibility thereof. Furthermore, it is considered that, since the compound containing basic nitrogen is a high molecular weight compound, the compound is liable to adsorb onto the particles and dispersibility of the particles is effectively improved by the aforesaid action of improving the impact force and shearing force and the stabilization effect of the dispersion by the compound after adsorption onto the particles.

On the other hand, when a charge controlling agent or a basic nitrogen-containing polymer is added to the system after dispersion, the aforesaid effect is not obtained and hence, it is impossible to reduce the particle size itself even if the aggregation of the particles after dispersion can be prevented.

As the ethylenic copolymer which is used as the coating material in this invention, various materials may be used, but preferred materials are as follows.

Preferred materials are, e.g., a copolymer of ethylene and acrylic acid or methacrylic acid, a ternary copolymer composed of ethylene, acrylic acid or methacrylic acid, and an acrylic acid ester or a methacrylic acid ester the alkyl group of which has from 1 to 5 carbon atoms, a copolymer of ethylene and vinyl acetate, a copolymer of ethylene and ethyl acrylate, a polymer (ionomer resin) formed by crosslinking at least a part of a copolymer of ethylene and methacrylic acid with a metal ion, a copolymer of ethylene and methyl methacrylate, a copolymer of ethylene and maleic anhydride, a copolymer of ethylene and vinyl chloride, a ternary copolymer of ethylene, vinyl acetate, and vinyl chloride, a ternary copolymer of ethylene, vinyl acetate, and an acrylate, a copolymer of ethylene and acrylic acid or methacrylic acid (wherein a part of the carboxy groups thereof is esterified by 3-hydroxypropanesulfonic acid as described in U.S. Pat. No. 4,681,831), a copolymer of ethylene and crotonic acid, and a ternary copolymer of ethylene, vinyl acetate, and an unsaturated carboxylic acid.

Of these copolymers, those which may be dissolved in a liquid having an affinity therewith (which is used in the aforesaid mixing step) at a temperature below 4° C., must be excluded. Also, copolymers which are not dissolved in a liquid having affinity therewith and are immiscible therewith even at temperatures higher than the boiling point of the liquid must be excluded.

Since the former copolymer has a high solubility, when the copolymer is used as a liquid developer, the coating properties thereof for a coloring agent are insufficient, which results in reducing the fixing property of the toner and makes the mechanical strength of images after fixing insufficient. Also, when the copolymer is used as a liquid developer for printing, stains form on the prints. In the case of using the latter copolymer, it is impossible to prepare a mixture and hence, the use of such a copolymer is, as a matter of course, inconvenient in this invention.

The invention is particularly effective for copolymers which are reluctant to disperse by ordinary methods (for example, a copolymer of ethylene and acrylic acid or methacrylic acid).

The ethylenic copolymer for use in this invention contains preferably from 40 to 99.9% by weight, and more preferably from 60 to 99.9% by weight of ethylene in the copolymer.

Of the aforesaid ethylenic copolymers for use in this invention, a copolymer of ethylene and acrylic acid or methacrylic acid, a copolymer of ethylene and ethyl acrylate, and a copolymer of ethylene and vinyl acetate are preferred. Of these copolymers, a copolymer of ethylene and methacrylic acid having a copolymerization ratio (by weight, hereinafter the same) of from 0.80/0.20 to 0.999/0.001, and particularly from 0.85/0.15 to 0.95/0.05 is preferred.

Practically, such a copolymer is commercially available as "Nuclel" (trade name, made by Mitsui-Du Pont Chemical Co.). Specifically, Nuclel N-699 having a copolymerization ratio of from 0.89/0.11 and Nuclel N-599 having a copolymerization ratio of from 0.90/0.10 are suitable. Also, these copolymers may be used as a mixture of two or more.

Of these ethylenic copolymers, the ethylenic copolymer having an acid group has a stronger bonding strength between molecules through hydrogen bonds, has high mechanical strength, and is excellent in heat stability. Thus, when such an ethylenic copolymer is used as a liquid developer, the liquid developer is superior in fixing property and transferring property to other ethylenic copolymers.

When an ethylenic copolymer having an acid group is used as a coating material, it is preferred that a basic nitrogen-containing polymer exists at the dispersing step together with the copolymer. As the acid group-containing ethylenic copolymer, a copolymer wherein a part of the other monomer being copolymerized with ethylene is replaced with an acid group-containing monomer is preferred. Such copolymers contain preferably from 0.1 to 30% by weight, and more preferably from 0.1 to 20% by weight of a monomer component containing acid group.

In this invention, there is no particular restriction on the ratio of the ethylenic copolymer as a coating material and the coloring agent, but the ethylenic copolymer is used usually from 0.1 to 10 parts by weight, and preferably from 0.5 to 5 parts by weight to 1 part by weight of the coloring agent.

As the ratio of the electrically insulating liquid having an affinity with the ethylenic copolymer as a coating material and the ethylenic copolymer at mixing, the amount of the liquid is usually from 0.2 to 20 parts by weight, and preferably from 1 to 10 parts by weight to 1 part by weight of the ethylenic copolymer.

As the electrically insulating liquid having an affinity with the ethylenic copolymer (which is used in the mixing step of this invention) and the electrically insulating liquid (which is used in the dispersion step and dilution step in this invention), various kinds of liquids can be used. However, a nonaqueous solvent having an electric resistance of more than $10^9\Omega\cdot$cm and a dielectric constant of lower than 3 is preferred, for the necessity of not spoiling electrostatic latent images during the development operation.

Also, it is necessary to select a liquid having a low dissolving property for the coating material. In general, aliphatic hydrocarbons, alicyclic hydrocarbons, aromatic hydrocarbons, halogenated hydrocarbons, polysiloxanes, etc., can be used. From the points of low volatility, high safety, nontoxicity, less offensive smell, etc., isoparaffinic petroleum solvents are suitable in this invention.

As isoparaffinic petroleum solvents, there may be used "Isopar G", "Isopar H", "Isopar L", and "Isopar K" (trade names, made by Esso Standard Co., Ltd.) and "Shell Sol 71" (trade name, made by Shell Oil Company).

When an isoparaffinic petroleum solvent used has an insufficient affinity with a coating material, it is preferred that all or a part of the isoparaffinic petroleum solvent is replaced by a liquid having a high dissolving property for the coating material, for example, an aromatic solvent such as toluene, xylene, Solvesso 100 or Solvesso 150. The mixing ratio of the isoparaffinic petroleum solvent to the aromatic solvent can be arbitrarily selected according to the property of the coating material.

As the charge controlling agent for use in this invention, materials which are usually used for this purpose can be used. Examples of the charge controlling agent are metal salts of a fatty acid (such as naphthenic acid, octenic acid, oleic acid, stearic acid, etc.), metal salts of sulfosuccinic acid ester, metal salts of oil-soluble sulfonic acid (as shown in JP-B- No. 45-556 (the term "JP-B" as used herein refers to an "examined Japanese patent publication"), and JP-A- Nos. 52-37435 and 52-37049), metal salts of a phosphoric acid ester (as shown in JP-B- No. 45-9594), metal salts of abietic acid or hydrogenated abietic acid (as shown in JP-B- No. 48-25666), calcium salts of alkylbenzenesulfonic acids (as shown in JP-B- No. 55-2620), metal salts of aromatic carboxylic acid or sulfonic acid (as shown in JP-A- Nos. 52-107837, 52-38937, 57-90643, and 57-139753), nonionic surface active agents (such as polyoxyethylated alkylamines), fats and oils (such as lecithin, linseed oil, etc.), organic acid esters of polyhydric alcohols, phosphoric acid ester series surface active agents (as shown in JP-A- No. 57-210345), and sulfonic acid resins (as shown in JP-B- No. 56-24944).

Also, the amino acid derivatives described in JP-A-Nos. 60-21056 and 61-50951 can be also used as the charge controlling agent in this invention.

The aforesaid amino acid derivatives for use in this invention are the compounds shown by the following formulae (1) or (2), or a reaction mixture obtained by reacting an amino acid and a titanium compound in an organic solvent and further reacting the reaction mixture with water.

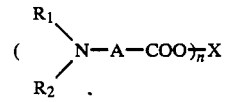

(1)

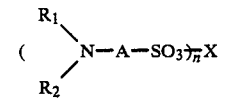

(2)

wherein $R_1$ and $R_2$ each represents a hydrogen atom, an alkyl group having from 1 to 22 carbon atoms, a substituted alkyl group (examples of the substituent are dialkylamino, alkyloxy, and alkylthio), an aryl group having from 6 to 24 carbon atoms, a substituted aryl group (examples of the substituent are dialkylamino, alkyloxy, alkylthio, chlorine, bromine, cyano, nitro, and hydroxy), an aralkyl group having from 6 to 24 carbon atoms, an acyl group having from 1 to 22 carbon atoms, an alkylsulfonyl group having from 1 to 22 carbon atoms, an alkylphosphonyl group having from 1 to 22 carbon atoms, an arylsulfonyl group having from 6 to 24 carbon atoms, or an arylphosphonyl group having from 6 to 24 carbon atoms; $R_1$ and $R_2$ may be the same or different; $R_1$ and $R_2$ may combine with each other to form a ring; with the proviso that $R_1$ and $R_2$ are not simultaneously hydrogen atoms; A represents an alkylene group having from 1 to 10 carbon atoms or a substituted alkylene group (examples of the substituent are alkyl having from 1 to 4 carbon atoms, hydroxy, nitro, cyano, chlorine or bromine); X represents a hydrogen atom, a monovalent to tetravalent metal, or a quaternary ammonium cation (for example, Na, K, Li, Ca, Mg, Sr, Ba, Ti, Ni, Cu, Co, Al, Cr, Zr or Fe); and n represents an integer of 1 to 4.

Of the aforesaid charge controlling agents, metal salts of sulfonic acid, lecithin, and the amino acid derivatives are preferred. These charge controlling agents may be used singly or as a mixture.

The addition amount of the charge controlling agent depends upon the amount of electrostatic charges of the liquid developer, but is generally from $1\times10^{-6}$ mol to $1\times10^{-3}$ mol, and preferably from $1\times10^{-5}$ mol to $1\times10^{-3}$ mol, per liter of the developer or per gram of the solid components of the liquid developer, or from 0.1 mg to 3 g, preferably from 1 mg to 1 g, for materials the molecular amount of which cannot be determined. The amount of the charge controlling agent added at the mixing step or the dispersing step shall be determined by the aforesaid value and the diluting ratio when using the dispersion by diluting.

Also, the charge controlling agent may, if necessary, be added to the system at the dilution step in addition to the mixing step and/or the dispersing step. The charge controlling agent added at the diluting step may be the same as or different from the charge controlling agent added at the mixing step and/or the dispersing step.

A basic nitrogen-containing polymer for use in this invention is soluble in an electrically insulating carrier liquid. Examples thereof are as follows.

1. Alkylated poly-N-vinylpyrrolidones which are commercially available as Antharon V-216 and V-220 (trade name, made by GAF CO.).

2. The following nitrogen-containing polymers or when the copolymers are insoluble in the carrier liquid for the liquid developer, copolymers of the polymers obtained by copolymerization with an acrylic or methacrylic acid ester monomer having an alkyl group of from 6 to 22 carbon atoms:

a. Dialkylaminoethyl (meth) acrylates such as dimethylaminoethyl methacrylate, diethylaminoethyl methacrylate, dimethylaminoethyl acrylate, etc.

b. Heterocyclic vinyl compounds containing basic nitrogen, such as N-vinylimidazole, vinylindazole, vinyltetrazole, 2-vinylquinoline, 2-vinylpyrazine, 2-vinylbenzoxazole, 4-vinylpyridine, oxazole, etc.

c. N-Vinyl heterocyclic ketone compounds, such as N-vinylpyrrolidone, N-vinylpiperidone, N-vinyloxazolidone, etc.

d. Styrene derivatives, such as dimethylaminostyrene, diethylaminostyrene, dimethylaminomethylstyrene, dioctylaminostyrene, etc.

e. (Meth)acrylamide and the derivatives thereof.

Of the aforesaid polymers, a copolymer of N-vinylpyrrolidone and a methacrylic acid ester having an alkyl group of from 6 to 22 carbon atoms is preferred.

The molecular weight of the basic nitrogen-containing polymer is about 5,000 to 500,000 (number average).

The addition amount of the basic nitrogen-containing polymer is from 0.01 to 5 parts by weight, and preferably from 0.05 to 3 parts by weight to 1 part by weight of the coloring agent.

As coloring agents for use in this invention, there may be used carbon black and other pigments and dyes which are conventionally used for liquid developers.

For example, Hansa Yellow (C.I. 11680), Benzidine Yellow (C.I. 21090), Benzidine Orange (C.I. 1110), Fast Red (C.I. 37085), Brilliant Carmine B (C.I. 6015-Lake), Phthalocyanine Blue (C.I. 74160), Phthalocyanine Green (C.I. 74260), Victorian Blue (C.I. 2595-Lake), Spirit Black (C.I. 50415), Oil Blue (C.I. 4350), Alkali Blue (C.I. 42770A), Fast Skarlet (C.I. 2315), Rhodamine 6B (C.I. 45160), Fast Sky Blue (C.I. 4200-Lake), and polychloro copper phthalocyanine, all may be used in the present invention.

To obtain the dispersion of the aforesaid components, a dispersing agent can be, if necessary, added to the system.

A dispersing agent is a resin for increasing the dispersibility of toners. That is, the resin can increase the dispersibility of toners by being dissolved in, or swelled with, the carrier liquid of a liquid developer.

Examples of the dispersing agent for use in this invention are rubbers, such as styrene-butadiene, vinyltoluene-butadiene, butadiene-isoprene, etc.; polymers of an acrylic monomer having a long chain alkyl group, such as 2-ethylhexyl (meth)acrylate, lauryl (meth)acrylate, stearyl (meth)acrylate, etc.; copolymers thereof with other monomer (such as styrene, (meth)acrylic acid, and the methyl esters, ethyl esters, and propyl esters thereof) and further graft copolymers and block copolymers.

Of these materials, synthetic rubber series dispersing agents are effective and further, the random or block copolymers of a styrene-butadiene copolymer are very effective in this invention.

The concentration of the particles in the liquid developer composed of the above-described composition is from 0.1 to 50 g, and preferably from 0.3 to 20 g per liter of the carrier liquid.

The production method of this invention is generally described below, practical examples thereof being set forth in the examples described below.

First, the mixing step is explained.

A mixture of a coloring agent, an ethylenic copolymer, and a hydrocarbon series nonpolar solvent (such as "Isopar L") as an electrically insulating liquid having an affinity with the copolymer or when the affinity with the copolymer is insufficient, a portion of the hydrocarbon series nonpolar solvent is replaced with an aromatic solvent such as "Solvesso 100" (trade name, mad by Esso Standard Co., Ltd.) and they are mixed under heating with stirring. The stirring is performed by a kneader, a Banbury mixer, a planetary mixer, a roll mill, a ball mill, an attritor, etc. Thus, the coloring agent is uniformly dispersed. The temperature in this step is higher than the softening point of the copolymer and lower than the boiling point of the solvent. The mixture is stirred for a sufficient period of time for dissolving the copolymer in the solvent or plasticizing the copolymer with the solvent and dispersing the coloring agent. The mixture is then cooled in the apparatus or outside the apparatus, whereby the mixture is solidified. The solidified mixture is ground as it is in the apparatus or in other means such as mixer. In this case, it is preferred that the solidified mixture is in spongy form. The ground mixture is placed in a dispersing device together with an electrically insulating liquid as a dispersion medium and a charge controlling agent or a basic nitrogen-containing polymer and they are dispersed by the addition of media. As the dispersing device, a media type device such as ball mill, paint shaker, attritor, dynomill, etc., is preferably used. The dispersion is carried out at a temperature set so as to not re-melt the solidified mixture causing aggregation. The temperature is ordinarily below 40° C.

The dispersion obtained by dispersing for a definite time then is diluted with an electrically insulating liquid (i.e., a carrier liquid) to provide a liquid developer for use. In this case, if necessary, a charge controlling agent or basic nitrogen-containing compound may be further added to the dispersion.

The liquid developer prepared by the method of this invention can be used for a photosensitive material using an organic photoconductor or an inorganic photoconductor. Also, the liquid developer of this invention can be used for developing electrostatic latent images formed by means other than light exposure, that is, by electrostatic charging of dielectrics caused by a charging stylus, etc.

As the organic photoconductor, various kinds of organic photoconductors can be used. Practical examples thereof are described in *Research Disclosure,* (RD No. 10938), page 61 (May, 1973), entitled "Electrophotographic Elements, Materials, and Process".

Practical examples are an electrophotographic photosensitive material composed of poly-N-vinylcarbazole and 2,4,7-trinitrofluorene-9-one (U.S. Pat. No. 3,484,239), poly-N-vinylcarbazole sensitized by a pyrylium salt series dye (JP-B- No. 48-25658), an electrophotographic photosensitive material composed of an organic pigment as the main component (JP-A- No. 49-37543), and an electrophotographic photosensitive material composed of an eutectic complex of a dye and a resin as the main component (JP-A- No. 47-10735).

Typical examples of the inorganic photoconductor for use in this invention are disclosed in R. M. Schaffert, *Electrophotography,* 260 to 374 (1975), published by Focal Press, London. Specific examples thereof are zinc oxide, zinc sulfide, cadmium sulfide, selenium, a selenium-tellurium alloy, a selenium-arsenic alloy, and a selenium-tellurium-arsenic alloy.

As described above, according to this invention, the dispersibility of a liquid developer using an ethylenic copolymer as a coating material is improved and images having good quality can be obtained. In particular, even in the case of using an ethylenic copolymer containing an acid group which is reluctant to disperse by conventional methods, a liquid developer having excellent dispersibility is obtained.

The following examples are given by way of illustration but not limitation of the scope and effect of this invention.

EXAMPLE 1

The following components were placed in a kneader (Bench Kneader PBV-0.1, made by Irie Shokai K.K.) and kneaded for 2 hours at 95° C. to provide a mixture. The mixture was cooled by water in the kneader to be solidified and then ground in the kneader by rotating the kneader.

| | Part by Weight |
|---|---|
| Ethylene-methacrylic acid copolymer (copolymerization ratio: 0.89/0.11 by weight ratio, Nuclel N-699, trade name, made by Mitsui-Du Pont Chemical Co.) | 3 |
| Carbon Black #40 (made by Mitsubishi Chemical Industries, Ltd.) | 1 |
| "Isopar L" (trade name, made by Esso Standard Co., Ltd.) | 12 |

The ground mixture was wet-dispersed in the following composition for 12 hours by means of a paint shaker (made by Toyo Seiki K.K.) using glass beads of about 3 mm diameter as media. Basic barium petronate used in the dispersion step was a charge controlling agent for applying negative electrostatic charge to the toners.

| | Part by Weight |
|---|---|
| Mixture described above | 1 |
| Basic barium petronate (made by Witco Co.) | 0.05 |
| "Isopar H" (trade name, made by Esso Standard Co., Ltd.) | 5 |

In addition, for comparison, the same composition was prepared as above, except that basic barium petronate was not added.

Each of the dispersions was diluted with "Isopar G" such that the content of the solid components of toner became 1 g per liter of the carrier liquid to provide each liquid developer. In addition, in the case of the dispersion of the mixture not containing basic barium petronate, the compound was added to the dispersion in the step of diluting the dispersion. The amount of basic barium petronate added in this case was 0.2 g as solid component per gram of the solid components of the dispersion.

The liquid developer prepared by dispersing the mixture in the existence of the charge controlling agent is designated as Developer A and the comparison liquid developer prepared by adding the charge controlling agent after dispersion is designated a Developer B.

The particle sizes of the developers were measured by a centrifugal precipitation type light transmission particle size measurement apparatus (CAPA-500, trade name, made by Horiba Seisakusho K.K.) and the amount of electrostatic charge was measured by a charge amount measuring device as described in JP-A-57-58176. The results are shown in Table 1 below. The polarities of Developers A and B were both negative.

TABLE 1

| | Particle Size (weight average) (μm) | Amount of Charge T (mV) | Amount of Charge I (mV) |
|---|---|---|---|
| Developer A | 2.8 | 21.0 | 10.0 |
| Developer B | 4.1 | 25.5 | 18.0 |

The charge amount T is the developer bulk and the charge amount I is the value of the supernatant liquid obtained by centrifugally separating the liquid developer (that is, the value based on the ion components in the carrier liquid). In this case, as the value of (T - I) is larger, the amount of the effective charge is larger. As the value of (I/T) is smaller, the value of the ion components giving the charge amount becomes less. These properties are advantageous for a liquid developer.

Developer A has an improved degree of dispersion, has large effective charge amount and contains less ion component as compared with Developer B. This demonstrates that Developer A is superior to Developer B with respect to these properties.

Next, a solution of 100 parts by weight of poly-N-vinylcarbazole (PVCz), 5 parts by weight of a copolymer of vinylidene chloride and acrylonitrile, 3 parts by weight of a copolymer of styrene and butadiene, and 1 part by weight of 2,6-di-t-butyl-4-[4-(N,N-dichloroethylamino)styryl]thiapyryrium tetrafluoroborate dissolved in 2,000 parts by weight of 1,2-dichloroethane was coated on a polyethylene terephthalate (PET) film of 100 μm thickness having a vapor-deposited layer of $In_2O_3$ of 60 nm in thickness ($In_2O_3$ conductivity-imparted PET film) and dried to remove the solvent to provide an electrophotographic film having a photoconductive layer of 5 μm in thickness.

The surface of the film was electrostatically charged at +350 V and imagewise exposed through a positive original to form electrostatic latent images.

The latent images were developed using the aforesaid Developers A or B. Developer A gave images having less image flow and double images, and which have good reproducibility of fine lines as compared to Developer B. Thus, Developer A is also superior from the point of view of imaging properties as compared to Developer B.

When the photosensitive material having the toner images was superposed on an anodically oxidized aluminum plate before drying the liquid developer so that the image layer is in contact with the surface of the aluminum plate and corona discharging of the same pole (negative) as that of the toner was applied to the photosensitive material side, the toner images are almost completely transferred at a transfer ratio of near 100%. By comparing the transferred images, it was confirmed that Developer A gave good transferred images having less image flow and broadening of line images as compared with Developer B.

EXAMPLE 2

| EXAMPLE 2 | Part by Weight |
|---|---|
| Ethylene-methacrylic acid copolymer (copolymerization ratio by weight: 0.89/0.11, "Nuclel 699" (trade name, made by Mitsui-Du Pont Chemical Co.)) | 3 |
| Carbon Black #40 (made by Mitsubishi Chemical Industries, Ltd.) | 1 |
| Basic barium petronate | 0.8 |
| "Isopar L" | 12 |

The above components were kneaded by a kneader for 2 hours at 95° C. as in Example 1 to provide a mixture. The mixture was solidified by cooling with water in the kneader and then the solidified mixture was ground in the kneader. The ground mixture was dispersed with the composition shown below for 12 hours by a paint shaker to provide a dispersion.

| | Part by Weight |
|---|---|
| Mixture obtained | 1 |
| "Isopar L" | 5 |

The dispersion was diluted with Isopar G, such that the content of the solid toner components became 1 g per liter of the carrier liquid and the content of basic barium petronate became 0.2 g per liter of the carrier liquid to provide a liquid developer (Developer C). The particle size of the liquid developer and the amount of charge were measured as in Example 1. The results obtained are shown in Table 2. The polarity of the developer was negative.

TABLE 2

| | Particle Size | Amount of Charge T | Amount of Charge I |
|---|---|---|---|
| Developer C | 2.7 μm | 22.5 mV | 10.0 mV |

It was also confirmed that Developer C has an improved degree of dispersion as compared with Developer B (obtained by kneading the aforesaid components without adding the charge controlling agent and dispersing the ground mixture) and also had almost the same degree of dispersion as Developer A (obtained by adding the charge controlling agent at the dispersion of the ground mixture).

When the developer was used for developing as in Example 1, Developer C gave images having less image flow and double images and which were excellent in the reproducibility of fine lines as compared with Developer B, the image quality being almost the same as those by Developer A.

EXAMPLE 3

| EXAMPLE 3 | Part by Weight |
|---|---|
| Ethylene-methacrylic acid copolymer (copolymerization ratio: 0.90/0.10 by weight ratio, Nuclel 599 (trade name, made by Mitsui-Du Pont Co.)) | 3 |
| Polychloro copper phthalocyanine ("Lionol Green YS", trade name, made by Toyo Ink Manufacturing Co., Ltd.) | 1 |
| "Isopar L" | 12 |

The above components were mixed and kneaded by a planetary mixer (130 LDM, made by Ross Co.) for 2 hours at 95° C. to provide a kneaded mixture. The mixture was solidified by cooling with water in the mixture and then the solidified mixture was ground by stirring.

The ground mixture was wet-dispersed with the following composition for 12 hours by a paint shaker and the dispersion thus obtained was diluted as in Example 1 to provide a liquid developer (Developer D).

| | Part by Weight |
|---|---|
| Mixture described above | 1 |
| Basic barium petronate | 0.05 |
| Isopar H | 5 |

Also, as a comparison, the aforesaid components were mixed and dispersed in the same manner as above, without adding basic barium petronate and then diluted as above, while adding the same amount of the charge controlling agent to provide a comparison liquid developer (Developer E).

The particle size and the amount of charge were measured as in Example 1 and the results obtained are shown in Table 3. The polarity of the developer was negative.

TABLE 3

| | Particle Size (μm) | Amount of Charge T (mV) | Amount of Charge I (mV) |
|---|---|---|---|
| Developer D | 2.4 | 25.0 | 5.3 |
| Developer E | 4.9 | 38 | 21.0 |

It was confirmed that Developer D (prepared by dispersing the aforesaid components in the existence of the charge controlling agent) had improved degree of dispersion, an increased effective charge amount, and less ion component ratio as compared to Developer E (prepared by dispersing the mixture of the aforesaid components without the addition of the charge controlling

EXAMPLE 4

In Example 3 described above, the charge controlling agent added at the dispersion step was added at the mixing step as in Example 2 to provide a mixture. The mixture was dispersed with the composition shown below as in Example 3 and the dispersion was diluted with "Isopar G" provide a liquid developer (Developer F).

| | Part by Weight |
|---|---|
| Mixture described above | 1 |
| "Isopar H" | 5 |

The particle size and the amount of electrostatic charge were measured as in Example 1 and the results obtained are shown in Table 4. The polarity of the developer was negative.

TABLE 4

| | Particle Size | Amount of Charge T | Amount of Charge I |
|---|---|---|---|
| Developer F | 2.5 μm | 24.5 mV | 6.0 mV |

As shown above, Developer F has an improved degree of dispersion and an increased effective charge amount as compared with Developer E prepared by dispersing the mixture of the aforesaid components as in Example 3.

EXAMPLE 5

By following the same procedure as in Example 3, except that the amino acid derivative shown in JP-A-60-21056 was used in place of the charge controlling agent, a liquid developer (Developer G) was prepared. The amino acid derivative used was a compound of formula (1) described above, wherein $R_1$=n-$C_8H_{17}$, $R_2$=n-$C_{13}H_{27}CO$, X=Ti, A=$C_2H_4$, n=2.

For comparison, a liquid developer (Developer H) was prepared by dispersing the mixture of the components without addition of the charge controlling agent and adding the same amount of the charge controlling agent at the dilution step only.

The particle size and the amount of electrostatic charge were measured as in Example 1. The results obtained are shown in Table 5. The polarity of the liquid developers was negative.

TABLE 5

| | Particle Size (μm) | Amount of Charge T (mv) | Amount of Charge I (mV) |
|---|---|---|---|
| Developer G | 3.0 | 18.0 | 7.5 |
| Developer H | 4.9 | 15.5 | 13.5 |

It was confirmed that Developer G had an improved degree of dispersion, an increased effective charge amount and less ion components as compared to Developer H.

When these developers were used for development as in Example 1, Developer H gave image flow and double image, and did not give good images. On the other hand, Developer G showed excellent imaging property with less image flow and almost no double images.

EXAMPLES 6 TO 8

By following the same procedure as in Example 1, except that the ethylenic copolymer was changed as shown in Table 6 below, liquid developers were prepared. In this case, both the cases of adding the charge controlling agent at the dispersion step ("added" in the table) and the case of not adding the charge controlling agent ("none" in the table) were tested. Other conditions were the same as those in Example 1.

TABLE 6

| Example No. | Copolymer | Charge Controlling Agent | Particle Size (μm) | Amount of Charge T (mV) | Amount of Charge I (mV) |
|---|---|---|---|---|---|
| 6 | Ethylene-Ethyl Acrylate Copolymer*1 | Added | 1.2 | 22.5 | 11.0 |
| 7 | Ethylene-Vinyl Acetate Copolymer*2 | None | 2.2 | 24.0 | 17.5 |
| | | Added | 1.3 | 22.0 | 12.0 |
| 8 | Ionomer Resin of Copolymer* of Ethylene and Methacrylic Acid*3 | None | 2.0 | 25.0 | 17.5 |
| | | Added 3.0 | 2.15 | 10.5 | |
| | | None | 4.3 | 26.0 | 18.0 |

*1: Ethylene-ethyl acrylate copolymer, EVAFLEX EEA A-703, trade name, made by Mitsui-Du Pont Chemical Co.
*2: Ethylene-vinyl acetate copolymer, EVAFLEX 420, trade name, made by Mitsui-Du Pont Chemical Co.
*3: Ionomer resin of ethylene-methacrylic acid copolymer, Hamilane 1652, trade name, made by Mitsui-Du Pont Chemical Co.
In the case of the resin*3, Solvesso 100 (trade name, made by Esso Standard Co, Ltd.) was used in place of Isopar L at the mixing step.

As shown in the above table, in the case of using each ethylenic copolymer in Examples 6 to 8, the degree of dispersion was improved by the coexistence of the charge controlling agent at the dispersion step.

Each of the dispersions was diluted as in Example 1, to provide a liquid developer. The development was carried out as in Example 1 using the developer.

The results showed that the developers prepared in the coexistence of the charge controlling agent at the dispersion step showed excellent imaging property with good sharpness of the edge portions of fine lines and less roughness of halftone portions.

EXAMPLE 9

The following components were placed in a kneader (Bench Kneader PBN-01, made by Irie Shokai K.K.) and kneaded for 2 hours at 95° C. to provide a mixture. The mixture was solidified by cooling with water in the kneader and then ground in the kneaded by rotating the kneader.

| | Part by Weight |
|---|---|
| Ethylene-methacrylic acid copolymer (copolymerization ratio: 0.89/0.11 by weight ratio, "Nuclel N-699" (trade name, made by Mitsui-Du Pont Chemical Co.)) | 3 |
| Carbon Black #40 (made by Mitsubishi Chemical Industries, Ltd.) | 1 |
| "Isopar L" (trade name, made by Esso Standard Co., Ltd.) | 12 |

The ground mixture was wet-dispersed with the composition shown below for 12 hours by a paint shaker (made by Toyo Seiki K.K.) using glass beads of about 3 mm diameter as media to provide a dispersion (Dispersion I).

| | Part by Weight |
|---|---|
| Mixture described above | 4 |
| Alkylated poly-N-vinylpyrrolidone ("Antharon V-216" (trade name, made by GAF Co.)) | 1 |
| "Isopar H" | 16 |

Then, by following the same procedure as above without the coexistence of alkylated poly-N-vinylpyrrolidone, Dispersion J was prepared as a comparison dispersion.

Each of the dispersions was diluted with "Isopar G" such that the concentration of solid components became 1 g per liter of the carrier liquid. The particle size was measured as in Example 1. The results are shown in Table 7 below.

TABLE 7

| | Particle Size |
|---|---|
| Dispersion I | 2.7 μm |
| Dispersion J | 4.8 μm |

It was confirmed that Dispersion I obtained by dispersing in the coexistence of alkylated poly-N-vinylpyrrolidone had A greatly improved degree of dispersion as compared with Dispersion J dispersed without the existence of alkylated poly-N-vinylpyrrolidone.

Then, each of Developers I and J was diluted by "Isopar G", such that the content of solid components became 1 g per liter of the carrier liquid. In this case, the amino acid derivative shown in JP-A-60-21056 was added in an amount of $1\times10^{-4}$ mol/liter. Thus, liquid developers (Developer I and Developer J) were prepared.

In addition, the charge controlling agent used above was added (i.e., a compound of formula (1) described hereinbefore, wherein $R_1$=n-$C_8H_{17}$, $R_2$=n-$C_{13}H_{27}CO$, X=Ti, A=$C_2H_4$, and n=2). The polarity of the developers was negative.

Electrostatic latent images were formed as in Example 1 and developed using each of Developer I and Developer J. The results showed that Developer I gave excellent images with less image flow and double images which were a fringe-form image defect occurring at the periphery of the image and which showed excellent reproducibility of the edge portions of line images.

In addition, the particle size of each developer was measured as in Example 1 and the results are shown in Table 8.

TABLE 8

| | Particle Size |
|---|---|
| Developer I | 2.7 μm |
| Developer J | 4.1 μm |

As shown in Table 7 and Table 8, the particle size of Developer I is the same as that of Dispersion I without containing the charge controlling agent, while the particle size of Developer J is smaller than that of Dispersion J without containing the charge controlling agent. This shows that the latter dispersion is very liable to aggregate. The results of the example show that, by the coexistence of alkylated poly-N-vinylpyrrolidone which is the basic nitrogen-containing polymer in this invention at the dispersion step, the cohesive force is weakened and the ground mixture of the components can be effectively dispersed.

Then, the photosensitive material having the toner images thus developed was superposed on an anodically oxidized aluminum plate before drying the liquid developer, such that the image layer was in contact with the surface of the aluminum plate and corona discharging of the same polarity (negative) as the toner was applied thereto from the side of the photosensitive material, whereby the toner images were almost completely transferred onto the aluminum plate at a transfer ratio of about 100%.

The comparison of the transferred images showed that Developer I gave almost the same imaging properties as on the photosensitive material, while Developer J showed image flow and broadening of line images.

EXAMPLE 10

The mixture prepared as in Example 9 was dispersed as in Example 9, while changing the addition amount of alkylated poly-N-vinylpyrrolidone (Antharon V-216) at the dispersion step. After dispersion, the dispersion obtained was diluted as in Example 9. Then, the particle size of each dispersion was measured as in Example 1 and the results are shown in Table 9.

TABLE 9

| Proportion of Mixture (part by weight) | Proportion of Alkylated Poly-N-vinylpyrrolidone (part by weight) | Particle Size (μm) |
|---|---|---|
| 4 | 0 | 4.1 |
| 4 | 0.1 | 4.0 |
| 4 | 0.4 | 3.2 |
| 4 | 1 | 2.7 |
| 4 | 2 | 1.9 |

From the results shown above, it can be seen that the degree of dispersion is more improved with the increase of the amount of alkylated poly-N-vinylpyrrolidone. The results show that the particle size can be controlled by the amount of alkylated poly-N-vinylpyrrolidone.

EXAMPLE 11

The following components were placed in a kneader (Bench Kneader PBV-01), made by Irie Shokai K.K.)

and kneaded for 2 hours at 95° C. to provide a mixture. The mixture was solidified by cooling with water in the kneader and then ground in the kneader by rotating the kneader.

| | Part by Weight |
|---|---|
| Ethylene-methacrylic acid copolymer (copolymerization ratio: 0.89/0.11 by weight ratio, Nuclel 699, trade name, made by Mitsui-Du Pont Chemical Co.) | 3 |
| Carbon Black #40 (made by Mitsubishi Chemical Industries, Ltd.) | 1 |
| Alkylated poly-N-vinylpyrrolidone (Antharon V-216, trade name, made by GAF Co.) | 1 |
| "Isopar L" | 12 |

Then, the ground mixture was dispersed with the composition shown below for 12 hours by a paint shaker as in Example 9, to provide a dispersion.

| | Part by Weight |
|---|---|
| Mixture described above | 1 |
| "Isopar H" | 4 |

Then, the charge controlling agent as in Example 9 was added to the dispersion as in Example 9, to provide a liquid developer (Developer K). The particle size thereof measured as in Example 1, and was 2.6 μm.

When the development was carried out as in Example 9 using the developer, images of almost the same image quality as the case of developing with Developer I prepared in the coexistence of alkylated poly-N-vinylpyrrolidone at the dispersing step in Example 9 was obtained.

The difference between Example 9 and Example 10 is that alkylated poly-N-vinylpyrrolidone is added at the dispersing step in Example 9, while the compound is added at the mixing step (or kneading step) in Example 10. In both the examples, alkylated poly-N-vinylpyrrolidone exists at the wet-dispersion step. It is considered that the coexistence of alkylated poly-N-vinylpyrrolidone at the dispersing step acts to disperse the ground mixture while weakening the cohesive force of the dispersion, whereby the impact force and shearing force at dispersion effectively act on the composition being dispersed.

EXAMPLE 12

Developer J was prepared by dispersing the ground mixture without coexisting alkylated poly-N-vinylpyrrolidone as in Example 9. This dispersion was diluted as in Example 9, while adding thereto alkylated poly-N-vinylpyrrolidone in the same amount a in Example 9 to provide a liquid developer (Developer L). The particle size thereof was the same as that of Developer J and the imaging property thereof was almost the same as that of Developer J. This shows that the addition of alkylated poly-N-vinyl-pyrrolidone to the system after dispersion does not provide the effects of this invention.

Example 13

By following the same procedure as in Example 9, Developer M was prepared using Dispersion I and basic barium petronate as a charge controlling agent in an amount of 0.1 g/liter.

When the development was carried out as in Example 9, excellent images having less image flow and excellent reproducibility of fine lines were obtained.

EXAMPLE 14

By following the same procedure as in Example 9, except that polychloro copper phthalocyanine ("Lionol Green YS", trade name, made by Toyo Ink Manufacturing Co., Ltd.) was used in place of the pigment in Example 9, a mixture was prepared. The mixture was dispersed as in Example 9 to provide Dispersion N containing alkylated poly-N-vinylpyrrolidone (Antharon V-216). Also, for comparison, Dispersion O, not containing alkylated poly-N-vinyl-pyrrolidone, was prepared.

Then, each of the dispersion was diluted as in Example 9 with the addition of the charge controlling agent as used in Example 9, to provide Developer N and Developer O, respectively. The particle size of each developer was measured as in Example 1 and the results are shown in Table 10.

TABLE 10

| | Particle Size |
|---|---|
| Developer N | 1.9 μm |
| Developer O | 4.9 μm |

As shown above, the particle size of Developer N, obtained by dispersing the ground mixture in the state of containing alkylated poly-N-vinylpyrrolidone, was smaller than that of Developer O, prepared by dispersing in the state of not containing the polymer. The dispersibility is improved in the former developer.

When the development was carried out as in Example 9 using each developer, Developer N gave less double images and showed good reproducibility of fine lines as compared to Developer O.

EXAMPLE 15

In Example 13, the ground mixture was dispersed in the coexistence of a copolymer of lauryl methacrylate and N-vinylpyrrolidone (copolymerization ratio: 0.9/0.1 by weight ratio, molecular weight (number average): $3.5\times10^4$) in place of alkylated poly-N-vinylpyrrolidone. Then, by following the same manner as in Example 13, Developer P was prepared. The particle size thereof measured as in Example 1 was 2.1 μm.

Developer P had a smaller particle size and higher degree of dispersion than Comparative Developer O, shown in Example 14.

When the development was carried out as in Example 9 using the developer, images with less double images, with good sharpness of edges of fine line, and which are excellent in the reproducibility of fine lines were obtained.

EXAMPLES 16 TO 18

By following the same procedure as in Example 14, except that each of the basic nitrogen-containing polymers shown in Table 11 below was used in place of the polymer in Example 14, liquid developers were prepared. The particle size of each developer is shown in Table 11.

TABLE 11

| Example | Basic Nitrogen-Containing Polymer | Particle Size (μm) |
|---|---|---|
| Example 16 Developer Q | Lauryl Methacrylate-Diethylaminoethyl Methacrylate Copolymer (copolymerization ratio by weight: 0.95/0.05, M.W. (number average): $4.2 \times 10^4$) | 2.0 |
| Example 17 Developer R | 2-Ethylhexyl Methacrylate-N-Vinylimidazole Copolymer (copolymerization ratio by weight: 0.95/0.05, M.W. (number average): $3.3 \times 10^4$) | 1.9 |
| Example 18 Developer S | Stearyl Methacrylate-Dimethylaminostyrene (copolymerization ratio by weight: 0.95/0.05, M.W. (number average): $5.2 \times 10^4$) | 2.1 |

Since the particle size of Comparative Developer O is 4.9 μm, as shown in Example 14, the aforesaid results demonstrate that the polymers used in the Examples are effective for the improvement of the degree of dispersion.

While the invention has been described in detail and with reference to specific embodiments thereof, it will be apparent to one skilled in the art that various changes and modifications can be made therein without departing from the spirit and scope thereof.

What is claimed is:

1. A method for producing an electrophotographic liquid developer comprising:

(A) a mixing step of stirring a mixture comprising a coloring agent, an ethylenic copolymer, and an electrically insulating liquid having an affinity with the copolymer, at a temperature higher than the softening point of the copolymer;

(B) a dispersing step of dispersing the mixture in an electrically insulating liquid, after cooling to a temperature below the softening point of the copolymer; and (C) a diluting step of diluting the dispersion with an electrically insulating liquid to provide a liquid developer for use; wherein step (A) and/or step (B) is performed in the presence of a basic nitrogen-containing polymer.

2. A method for producing an electrophotographic liquid developer as in claim 1, wherein said ethylenic copolymer contains from 40 to 99.9% by weight of ethylene.

3. A method for producing an electrophotographic liquid developer as in claim 1, wherein said ethylenic copolymer is a copolymer of ethylene and methacrylic acid having a copolymerization ratio by weight of from 0.80/0.20 to 0.999/0.001.

4. A method for producing an electrophotographic liquid developer as in claim 1, wherein said mixture in said mixing step (A) comprises said ethylenic copolymer in an amount of from 0.1 to 10 parts by weight to 1 part by weight of said coloring agent.

5. A method for producing an electrophotographic liquid developer as in claim 1, wherein said mixture in said mixing step (A) comprises said electrically insulating liquid having an affinity with the ethylenic copolymer in amount of from 0.2 to 20 parts by weight to 1 part by weight of the ethylenic copolymer.

6. A method for producing an electrophotographic liquid developer as in claim 1, wherein said electrically insulating liquid having an affinity with the ethylenic copolymer has an electric resistance of more than $10^9$ Ω·cm and a dielectric constant of 3 or less.

7. A method for producing an electrophotographic liquid developer as in claim 1, wherein said basic nitrogen-containing polymer is a copolymer of N-vinylpyrrolidone and a methacrylic acid ester.

8. A method for producing an electrophotographic liquid developer as in claim 1, further comprising a dispersing agent.

9. A method for producing an electrophotographic liquid developer as in claim 8, wherein said dispersing agent is a synthetic rubber series dispersing agent, or a random or block copolymer of a styrene-butadiene copolymer.

* * * * *